United States Patent [19]

Schmid

[11] Patent Number: 5,025,853

[45] Date of Patent: Jun. 25, 1991

[54] CONTINUOUS CASTING APPARATUS WITH ELECTROMAGNETIC STIRRER

[75] Inventor: Markus Schmid, Wadenswil, Switzerland

[73] Assignee: Concast Standard AG, Zurich, Switzerland

[21] Appl. No.: 462,807

[22] Filed: Jan. 10, 1990

[30] Foreign Application Priority Data

Jan. 19, 1989 [CH] Switzerland ..... 164/89

[51] Int. Cl.[5] ..... B22D 27/02; B22D 11/00

[52] U.S. Cl. ..... 164/504; 164/468

[58] Field of Search ..... 164/466, 468, 502, 504

[56] References Cited

U.S. PATENT DOCUMENTS

| | | | |
|---|---|---|---|
| 3,167,829 | 2/1965 | Hess | 164/442 |
| 3,804,147 | 4/1974 | Babel | 164/468 |
| 3,967,362 | 7/1976 | Capriotti | 164/442 |
| 4,178,979 | 12/1979 | Birat | 164/468 |
| 4,355,679 | 10/1982 | Wilkins | 164/466 |
| 4,473,105 | 9/1984 | Pryor | 164/66.1 |
| 4,690,200 | 9/1987 | Okamoto | 164/504 |

FOREIGN PATENT DOCUMENTS

| | | | |
|---|---|---|---|
| 2731238 | 4/1987 | Fed. Rep. of Germany . | |
| 2911187 | 9/1987 | Fed. Rep. of Germany . | |
| 57-94458 | 6/1982 | Japan | 164/504 |

*Primary Examiner*—Richard K. Seidel
*Assistant Examiner*—Rex E. Pelto
*Attorney, Agent, or Firm*—Peter K. Kontler; Tobias Lewenstein

[57] ABSTRACT

A continuous casting apparatus has a mold table which is supported by an oscillator and carries a continuous casting mold. The mold is provided with a casting passage having an inlet end for molten material and an outlet end for a continuously cast strand. An electromagnetic stirrer for the molten material is mounted on the mold table independently of the mold adjacent to the outlet end thereof.

19 Claims, 1 Drawing Sheet

CONTINUOUS CASTING APPARATUS WITH ELECTROMAGNETIC STIRRER

BACKGROUND OF THE INVENTION

The invention relates generally to continuous casting.

More particularly, the invention relates to an arrangement for stirring the molten core of a continuously cast strand in a continuous casting apparatus.

It is known to stir the molten core of a continuously cast strand during a continuous casting procedure. Stirring is accomplished by means of electromagnetic forces either in the mold or along the secondary cooling zone.

For billets and blooms, the stirrer is often incorporated in the mold. The electromagnetic field must here penetrate the mold wall which, as a rule, consists of copper. The magnetic field must further penetrate a gap for cooling water as well as the walls defining the gap and the walls of the stirrer housing. This results in a high consumption of electricity and correspondingly high operating costs.

The West German Patent No. 29 11 187 discloses a continuous casting mold which is constructed as a composite body and consists of an upper mold portion and a lower mold portion. The upper mold portion has copper walls while the lower mold portion has walls of antimagnetic material and is provided with stirring coils. Since the casting passage in this mold is defined by two different metals, problems can occur at the joint between the upper and lower mold portions due to the different coefficients of expansion. Gaps can be created at the joint and warping can take place thereby generating difficulties in starting, defects in the strand and breakouts.

The West German Patent No. 27 31 238 discloses a mold which is equipped with a stirrer at the end of the casting passage. The stirrer is screwed to the bottom of the mold and the length of the stirrer can be changed depending upon the requirements. The plurality of stirrers in and below the mold causes the consumption of electricity to be high. Moreover, the stirrers must necessarily be demounted with the mold during each mold change. In addition, new molds and, as a rule, new mold tables as well, are required when installing stirrers in existing continuous casting apparatus which previously did not have stirrers.

SUMMARY OF THE INVENTION

It is an object of the invention to provide a stirring arrangement which makes it possible to effectively stir the molten core of a continuously cast strand with relatively low energy consumption.

Another object of the invention is to provide a stirring arrangement which allows a mold change to be carried out relatively rapidly and simply with or without a stirrer change.

An additional object of the invention is to reduce the investment costs for a stirring arrangement of the type having a stirrer which is associated with a mold.

It is also an object of the invention to provide a stirring arrangement which enables a stirrer to be installed in an existing continuous casting apparatus constructed without stirrers using only a few new structural components.

A further object of the invention is to provide a relatively efficient and inexpensive arrangement for stirring the molten core of a continuously cast strand in the region of a mold outlet which makes it possible to perform a mold change relatively rapidly and simply with or without a stirrer change and requires only a few new structural components to equip an existing continuous casting apparatus having no stirrer with such an item.

The preceding objects, as well as others which will become apparent as the description proceeds, are achieved by the invention.

A continuous casting apparatus in accordance with the invention comprises an open-ended mold having an inlet end for molten material and an outlet end for a continuously cast strand of the material, a support, and means for oscillating the support. The apparatus further comprises first mounting means for mounting the mold on the support with the outlet end at a predetermined location, a stirrer for the molten material, and second mounting means for mounting the stirrer on the support independently of the mold in the region of the predetermined location.

The support may include a mold table and the stirrer may be designed to generate an electromagnetic field capable of creating a stirring action in the molten material. The electromagnetic field may be a rotary field.

The stirring arrangement of the invention and the mounting of the same on the mold table per the invention make it possible to operate stirrers which yield a vigorous stirring action at low electrical power. The stirrer which is mounted in accordance with the invention oscillates with the mold table and is directly adjacent to the mold outlet. This stirrer generates an adequate stirring force, that is, an adequate rotational motion, in the molten bath within the mold so that stirrers in the mold itself may be eliminated. Mold changes can be accomplished more rapidly and easily than heretofore without demounting the stirrer and, when installing stirrers in existing continuous casting apparatus which previously lacked stirrers, old molds without stirrers can continue to be used. Moreover, only a few new structural components are required to mount a stirrer in such an existing apparatus.

There are various ways of mounting the stirrer on the mold table. According to a particularly advantageous embodiment of the invention, the mold table is provided with seating, centering and locking elements for the stirrer. Seating, centering and locking elements independent of those for the stirrer can be provided in order to seat, center and lock the mold on the mold table.

When installing a stirrer in an existing continuous casting installation which had no stirrers previously, it is of particular advantage to design in such a manner that the existing molds, which lack stirrers, can be centered and locked on the mold table via an intermediate member or carrier. The stirrer may have a peripheral flange or peripheral flanges which serve to seat the stirrer on the mold table and, as a rule, the width of the carrier as measured in a plane through the carrier, the stirrer and the stirrer flange or flanges will be greater than the width of the stirrer at the flange or flanges.

The stirrer may be provided with an opening which is in register with the casting passage of the mold and allows the continuously cast strand issuing from the mold to pass through the stirrer. An optimal geometric configuration of the stirrer as regards wear, cooling and efficiency can be achieved by designing the opening so that an air gap exists between the stirrer and the strand. The continuous casting apparatus may then be provided with spray nozzles which are arranged so that spray from the latter penetrates the air gap. In accordance with an advantageous embodiment of the invention, the opening and air gap diverge in a direction away from the mold, i.e., in the direction of travel of the strand.

The stirrer may comprise one or more coils which function to generate the electromagnetic field responsible for the stirring action in the molten material. The stirrer may further comprise a casing for the coils and such casing may define the opening for the strand. A vigorous stirring effect at relatively low electrical power may here be achieved by making the casing, or at least the portion of the casing between the coils and the strand, i.e., at least the portion of the casing which circumscribes the opening, of corrosion-resistant steel.

A protective shield of corrosion-resistant steel may be disposed between the stirrer and the strand surface, that is, within the opening in the stirrer, to protect the stirrer against heat radiation, outflowing or escaping molten material in the event of a breakout, and so on. The mold may include a mold tube which defines the casting passage and the protective shield may overlap the mold tube or may be arranged so that an end face of the protective shield is in abutment with an end face of the mold tube. The protective shield may be designed to be interchangeable, preferably from below, i.e., the protective shield is preferably removable in a direction away from the mold. A water cooling arrangement may be disposed between the stirrer and the protective shield.

A substantial reduction in investment costs can be achieved by designing the stirrer with coils which operate at the frequency of an electrical main or an electrical power grid. The coils preferably operate at a frequency of 50 to 60 Hertz.

The mold and the stirrer define a path along which the strand travels in a predetermined direction. The strand, which may consist of a solidified outer shell and a molten core during travel through the mold and the stirrer, has a longitudinal axis and the path of travel of the strand likewise has a longitudinal axis coincident with that of the strand. The stirrer coils may be arranged in such a manner that the stirrer generates a rotary electromagnetic field which is transverse to the direction of travel of the strand and causes the molten core of the strand to undergo motion along a rotary path essentially concentric to the common longitudinal axis of the strand and its path of travel.

Although the stirrer is mounted on the mold table separately from the mold, the stirrer is situated adjacent to the mold outlet during the casting operation. In many cases, there will be no measurable gap, or a hardly measurable gap, between the stirrer and the mold. Preferably, a gap ranging from a few tenths of a millimeter up to 5 millimeters is present between the stirrer and the mold and, in exceptional situations, such gap can be as large as 20 millimeters. However, larger gaps decrease the stirring action in the mold and, in the event of a breakout, enhance the entry of molten material between the mold and the stirrer.

According to one embodiment of the invention, the stirrer and the mold are each provided with a cooling system and these two cooling systems are independent of one another. A water spray cooling system may be provided for the strand downstream of the mold and the stirrer cooling system is advantageously interconnected with such spray cooling system. The stirrer cooling system may include a spray water cooling device which is installed between the stirrer and the protective shield.

The novel features which are considered as characteristic of the invention are set forth in particular in the appended claims. The improved stirring arrangement itself, however, both as to its construction and its mode of operation, together with additional features and advantages thereof, will be best understood upon perusal of the following detailed description of certain specific embodiments when read in conjunction with the accompanying drawings.

DESCRIPTION OF THE PREFERRED EMBODIMENTS

Figure 1:
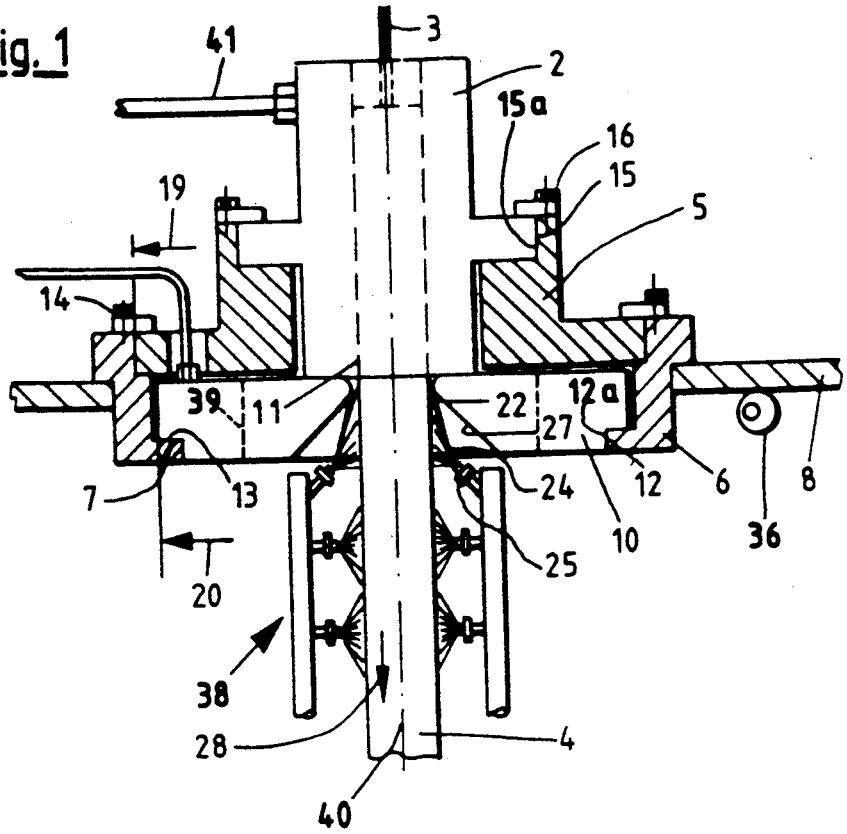
FIG. 1 is a partly sectional side view of a continuous casting apparatus showing a continuous casting mold and a stirrer for molten material mounted on an oscillatory table.

Referring to FIG. 1, a portion cf a continuous casting apparatus is illustrated. The continuous casting apparatus is here a Vertical or curved-mold apparatus of the type commonly used for the continuous casting of metal, especially steel, and the portion of the continuous casting apparatus shown is the upper portion thereof. The continuous casting apparatus is preferably designed to cast billets, blooms, plates, etc.

The apparatus includes a continuous casting mold 2 having a generally vertical orientation. The upper and lower ends of the mold 2 are open, that is, the mold 2 is open-ended, and the upper end constitutes an inlet end for a stream 3 of molten material which is here assumed to be steel. The lower end of the mold 2 constitutes an outlet end for a continuously cast strand 4 of the molten steel teemed into the mold 2. The mold 2 is provided with a casting passage 11 which extends between the upper and lower ends thereof and has a generally vertical orientation. The casting passage 11 may be defined by a mold tube consisting of copper or a copper alloy (such a mold tube is shown at 32 in FIGS. 2 and 3). A cooling system 41 is provided for the mold 2 and is arranged to circulate cooling Water through the latter so as to cool the mold tube and the surrounding parts of the mold 2.

Figure 2:
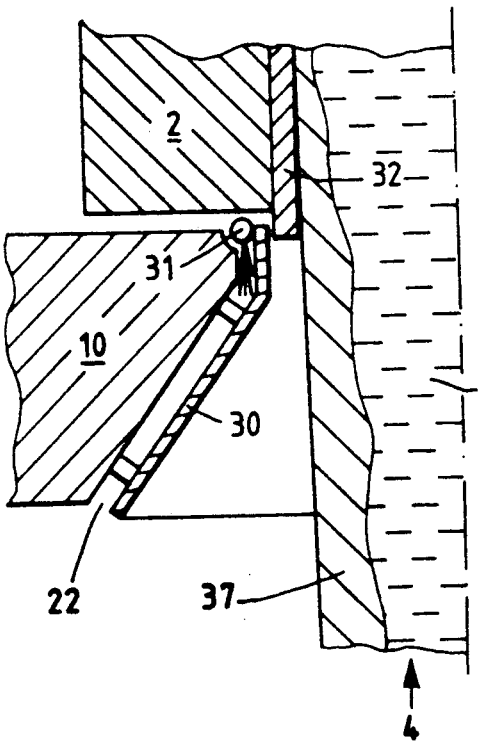
FIG. 2 is an enlarged, fragmentary, vertical sectional view through a mold and a stirrer in another embodiment of a continuous casting apparatus.
Figure 3:
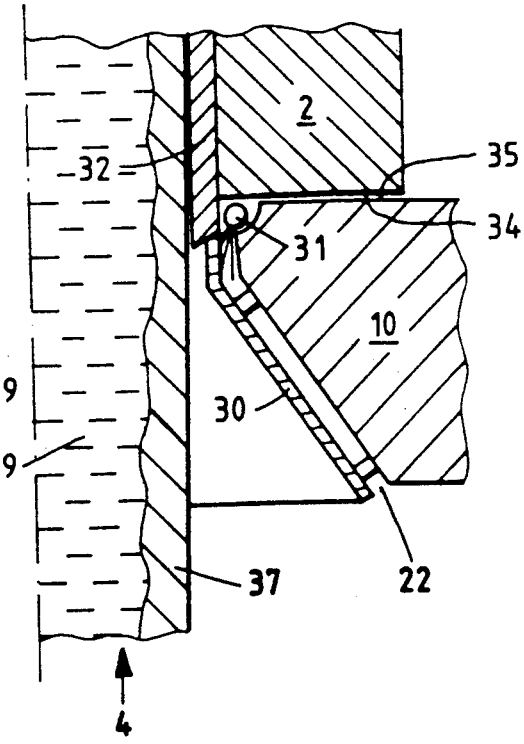
FIG. 3 is similar to FIG. 2 but illustrates an additional embodiment of a continuous casting apparatus.

The strand 4 is formed in the mold 2 by solidification of the molten steel which is adjacent to the inner surface of the mold tube. This results in the formation of a shell of solidified steel which surrounds a core of molten steel and the strand 4 consists of a solidified shell and a molten core within and immediately below the mold 2, i.e., the strand 4 is only partially solidified within and immediately below the mold 2, FIGS. 2 and 3 show a solidified shell 37 and a molten core 29.

The mold 2 sits on a carrier or intermediate member 5 which, in turn, rests on a guiding section 6 of a mold table or support 8. An oscillator 36 is arranged to oscillate or reciprocate the mold table 8, and hence the mold 2, along a direction substantially parallel to the casting passage 11.

The partially solidified strand 4 is withdrawn from the casting passage 11 of the mold 2 in a direction indicated by the arrow 28, i.e., in a downward direction. A stirrer 10 for the molten core 29 of the strand 4 is disposed immediately below or downstream of the casting passage 11. The stirrer 10 is separate from the mold 2 and is mounted on the guiding section 6 of the mold table 8 independently of the mold 2. The stirrer 10 has centering portions provided with centering surfaces 12 and the guiding section 6 has centering portions which are complementary to those of the stirrer 10 and are provided with centering surfaces 12a. The centering surfaces 12 and 12*a* cooperate to hold the stirrer 10 in a predetermined position on the mold table 8. The centering portions of the guiding section 6 are further provided with seats 13 which carry the stirrer 10. The stirrer 10 is locked or clamped to the mold table 8 by means of locking or clamping devices 14.

The mold 2 has its own centering portions and these centering portions, which may be constituted by flange portions of the mold 2, are provided with centering surfaces 15. As indicated previously, the mold 2 in the illustrated embodiment is mounted on the mold table 8 via the carrier 5 and the latter has centering portions which are complementary to those of the mold 2 and are provided with centering surfaces 15*a*. The centering surfaces 15 and 15*a* cooperate to hold the mold 2 in a predetermined position on the mold table 8. The carrier 5 and the mold 2 are locked or clamped to the mold table 8 by means of their own locking or clamping devices 16.

The stirrer 10 has peripheral flange portions 7 which rest on the seats 13 of the guiding section 6 constituting part of the mold table 8. The width of the stirrer 10 as measured across the flange portions 7 is indicated at 20 while the width of the carrier 5 is indicated at 19, and the width 19 of the carrier 5 exceeds the width 20 of the stirrer 10.

The carrier 5 may be eliminated. The mold 2 may then be provided with a flange of appropriate size which is directly centered on and clamped to the mold table 8.

The stirrer 10 includes one or more coils 39 capable of generating an electromagnetic field and a casing 27 which houses the coils 39. The stirrer 10 has an opening 22 which is in register with the casting passage 11 and allows the strand 4 to travel through the stirrer 10. The width of the opening 22 is greater than the width of the strand 4 so that an air gap is defined between the stirrer 10 and the strand 4. The opening 22, as well as the air gap, diverge strongly in a direction away from the mold 2, that is, in the direction of travel 28 of the strand 4. The casing 27, or at least the portion of the casing 27 which circumscribes the opening 22 and is located between the coils 39 and the strand 4, is composed of a corrosion-resistant steel.

A secondary cooling zone for the strand 4 is situated below, i.e., downstream of, the stirrer 10 and comprises a spray water cooling system 38. The cooling system 38 includes several groups of spray nozzles 25 and each of the spray nozzles 25 is designed to produce a water spray 24. The various groups are disposed at different levels and the nozzles 25 of the uppermost group are arranged in such a manner that the respective water sprays 24 penetrate the opening 22 of the stirrer 10, and hence the air gap between the stirrer 10 and the strand 4, from below.

The casting passage 11 of the mold 2 and the opening 22 of the stirrer 10 define a predetermined path of travel for the strand 4 and such path has a longitudinal axis 40. The strand 4 likewise has a longitudinal axis and the longitudinal axis of the strand 4 coincides with the longitudinal axis 40. As a rule, the coils 39 of the stirrer 10 will be arranged to generate a rotary electromagnetic field which is transverse to the common axis 40 of the strand 4 and its path of travel as well as to the direction of travel 28 of the strand 4. Such a rotary electromagnetic field is operative to set the molten core of the strand 4 into motion along a rotary path. It is preferred for the coils 39 of the stirrer 10 to be arranged in such a manner that the electromagnetic field generated thereby causes motion of the molten core along a rotary path which is essentially concentric with the common longitudinal axis 40 of the strand 4 and its path of travel. Motion of the molten core along a rotary path results in stirring of the molten core.

The coils 39 of the stirrer 10 are preferably designed to operate at the frequency of the alternating current supplied by an electrical power grid or electrical main. For example, the coils 39 may be designed to operate at a frequency of 50 to 60 Hertz.

Referring to FIG. 2, the same reference numerals as in FIG. 1 are used to identify similar elements. FIG. 2 shows that a protective shield 30 for the stirrer 10 may be disposed in the opening 22 of the latter. The protective shield 30 is situated between the strand 4 and the casing 27 of the stirrer 10. The upper end of the protective shield 30 overlaps the lower end of the copper tube 32 constituting part of the mold 2.

In FIG. 3, the same reference numerals as in FIGS. 1 and 2 are again used to identify similar elements. The continuous casting apparatus of FIG. 3 resembles that of FIG. 2 but differs therefrom in that the protective shield 30 and the copper tube 32 do not overlap. Instead, the upper end face of the protective shield 30 of FIG. 3 abuts the lower end face of the copper tube 32.

The protective shield 30 is designed to be interchangeable. Preferably, the protective shield 30 is mounted in such a manner that it can be exchanged from below when the stirrer 10 and the protective shield 30 are installed in the continuous casting apparatus. In other words, the protective shield 30 is preferably mounted so that it can be withdrawn by moving the same through the lower end of the opening 22 in a direction away from the mold 2 and so that a replacement shield can be installed by inserting the latter through the lower end of the opening 22 in a direction towards the mold 2.

A cooling arrangement may be provided for the stirrer 10. As illustrated in FIGS. 2 and 3, the cooling arrangement may be open and may include one or more spray nozzles 31 which are designed to direct water sprays between the protective shield 30 and the casing 27 of the stirrer 10. The stirrer cooling arrangement 31 is preferably independent of the mold cooling system 41 and may be interconnected with the strand cooling system 38.

With reference to FIG. 3, the mold 2 has a lower end face 34 while the stirrer 10 has an upper end face 35 which confronts the mold end face 34. Although the stirrer 10 and the mold 2 are installed on the mold table 8 independently of one another, it is preferred for the gap between the mold end face 34 and the stirrer end face 35 to be kept to a minimum. The width of the gap preferably does not exceed 5 millimeters and may be as small as a fraction of a millimeter. It is also possible for the mold end face 34 to abut the stirrer end face 35 so that the gap between the end faces 34,35 is non-existent, i.e., the width of the gap is zero millimeters.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A continuous casting apparatus, comprising an open-ended mold having an inlet end for molten material and an outlet end for a continuously cast strand of the material; a support; means for oscillating said support; first mounting means for mounting said mold on said support independent of a stirrer; mold centering means on said support; a stirrer for the molten material; second mounting means, different from said mold molding means, for mounting said stirrer on said support downstream and adjacent of said outlet end; and stirrer centering means on said support separate from said mold centering means.

2. The apparatus of claim 1, wherein said stirrer comprises a stirrer centering portion complementary to said stirrer centering means.

3. The apparatus of claim 1, wherein said second mounting means comprises a seat on said support for seating said stirrer or a locking device for securing said stirrer to said support.

4. The apparatus of claim 1, wherein said mold comprises a mold centering portion for centering said mold on said support, said first mounting means including a locking device for securing said mold to said support.

5. The apparatus of claim 4, wherein said first mounting means comprises a carrier for said mold having a carrier centering portion complementary to said mold centering portion, said locking device being designed to secure said carrier to said support.

6. The apparatus of claim 5, wherein said stirrer comprises a peripheral flange designed to be seated on said support, said stirrer having a first width as measured at said flange and said carrier having a second width greater than said first width.

7. The apparatus of claim 1, wherein said stirrer is provided with an opening for the strand; and further comprising at least one spray nozzle arranged to spray said opening.

8. The apparatus of claim 7, wherein said opening diverges in a direction away from said mold.

9. The apparatus of claim 1, wherein said stirrer comprises at least one coil for generating an electromagnetic field and a casing for said coil, said casing having a portion of corrosion-resistant steel which defines an opening for the strand.

10. The apparatus of claim 1, wherein said stirrer comprises at least one coil for generating an electromagnetic field, said coil being designed to operate at the frequency of an electrical power grid.

11. The apparatus of claim 10, wherein said stirrer comprises means for operating said coil at a frequency of about 50 to about 60 Hertz.

12. The apparatus of claim 1, wherein said mold and said stirrer define a path for the strand and said path has a longitudinal axis, said stirrer comprising at least one coil for generating a rotary electromagnetic field which is transverse to, and is operative to cause motion of the molten material along a rotary path substantially concentric with, said axis.

13. The apparatus of claim 1, further comprising first cooling means for said mold and second cooling means for said stirrer, said second cooling means being substantially independent of said first cooling means.

14. The apparatus of claim 13, further comprising spray cooling means for the strand, said second cooling means and spray cooling means being interconnected.

15. The apparatus of claim 1, wherein said mold has a first end face and said stirrer has a second end face confronting said first end face, said end faces being separated by about 5 mm at most.

16. The apparatus of claim 1, wherein said stirrer is provided with an opening for the strand; and further comprising a shield in said opening for shielding said stirrer from the strand, said shield being removable from said opening in a direction away from said mold.

17. The apparatus of claim 16, wherein said mold comprises a tube and said shield overlaps said tube.

18. The apparatus of claim 16, wherein said shield has a first end face and said mold comprises a tube having a second end face in abutment with said first end face.

19. The apparatus of claim 16, further comprising cooling means between said stirrer and said shield.

* * * * *